US009146027B2

(12) United States Patent
Zantout et al.

(10) Patent No.: US 9,146,027 B2
(45) Date of Patent: Sep. 29, 2015

(54) DEVICE FOR HOLDING A SOURCE OF LED LIGHT

(75) Inventors: Alan E. Zantout, Sycamore, IL (US); Dennis M. Breen, IV, West Chicago, IL (US); Benjamin D. Swedberg, Sycamore, IL (US)

(73) Assignee: IDEAL Industries, Inc., Sycamore, IL (US)

( * ) Notice: Subject to any disclaimer, the term of this patent is extended or adjusted under 35 U.S.C. 154(b) by 273 days.

(21) Appl. No.: 13/434,990

(22) Filed: Mar. 30, 2012

(65) Prior Publication Data

US 2013/0077326 A1 Mar. 28, 2013

Related U.S. Application Data

(60) Provisional application No. 61/473,475, filed on Apr. 8, 2011.

(51) Int. Cl.
*F21V 21/30* (2006.01)
*F21V 21/088* (2006.01)
(Continued)

(52) U.S. Cl.
CPC ..... *F21V 21/088* (2013.01); *F21V 17/005* (2013.01); *F21V 19/004* (2013.01); *F21V 19/0055* (2013.01); *F21Y 2101/02* (2013.01)
USPC ..... 362/396; 362/647; 362/649

(58) Field of Classification Search
CPC ..... F21V 17/00; F21V 17/06; F21V 17/164; F21V 17/18; F21V 15/04; F21V 19/001; F21V 21/34; F21V 21/00; F21V 21/14; F21V 21/116; F21V 21/088; F21V 21/06; F21V 21/08; F21V 9/1355; F21V 9/1375
USPC ..... 362/285–289, 382–456, 646, 647, 649
See application file for complete search history.

(56) References Cited

U.S. PATENT DOCUMENTS 5,379,204 A 1/1995 Paterson
D627,296 S 11/2010 Vogt et al.
(Continued)

FOREIGN PATENT DOCUMENTS

CN 101675289 3/2010
EP 2706292 A1 3/2014
WO WO 2010061746 A1 * 6/2010

OTHER PUBLICATIONS

The Int. Bureau of WIPO, Int. Preliminary Report on Patentability issued on PCT/US2012/031801, received Oct. 17, 2013, 8 pages.
(Continued)

*Primary Examiner* — Anh Mai
*Assistant Examiner* — Nathaniel Lee
(74) *Attorney, Agent, or Firm* — Greenberg Traurig, LLP

(57) ABSTRACT

A lamp holder for holding a source of LED light includes a lamp holding component that is sized and arranged to securely receive the source of LED light. Keyed openings, engageable with fasteners associated with the mounting surface, are used to releasably attached the lamp holding component to the mounting surface and to urge the source of LED light against the mounting surface once the lamp holding component is attached thereto. Electrical contacts carried by the lamp holding component, provided to engage corresponding electrical contacts of the source of LED light, are also arranged to urge the source of LED light against the mounting surface when the lamp holding component is attached to the mounting surface. The lamp holding component also includes resiliently mounted holding elements for releasably holding the source of LED light in an accessible location.

15 Claims, 8 Drawing Sheets

(51) Int. Cl.

| | |
|---|---|
| ***F21V 17/00*** | (2006.01) |
| ***F21V 19/00*** | (2006.01) |
| *F21V 21/14* | (2006.01) |
| *F21Y 101/02* | (2006.01) |

(56) References Cited

U.S. PATENT DOCUMENTS

| | | | | |
|---|---|---|---|---|
| 7,892,022 | B2 | 2/2011 | Mostoller et al. | |
| 7,988,336 | B1 * | 8/2011 | Harbers et al. | 362/294 |
| 2009/0003009 | A1 | 1/2009 | Tessnow et al. | |
| 2009/0196034 | A1 | 8/2009 | Gherardini et al. | |
| 2009/0203254 | A1 * | 8/2009 | Weber et al. | 439/541 |
| 2009/0251916 | A1 | 10/2009 | Tanaka et al. | |
| 2009/0321598 | A1 | 12/2009 | Vann et al. | |
| 2010/0290236 | A1 | 11/2010 | Gingrich, III et al. | |
| 2011/0028015 | A1 | 2/2011 | Mostoller et al. | |
| 2011/0136374 | A1 | 6/2011 | Mostoller et al. | |
| 2011/0136390 | A1 | 6/2011 | Gingrich, III | |
| 2011/0136394 | A1 | 6/2011 | Mostoller et al. | |
| 2011/0140136 | A1 | 6/2011 | Daily et al. | |
| 2011/0261572 | A1 * | 10/2011 | Watanabe et al. | 362/373 |
| 2012/0051065 | A1 * | 3/2012 | Daily et al. | 362/311.02 |
| 2012/0051068 | A1 | 3/2012 | Pelton et al. | |

OTHER PUBLICATIONS

ISA/US, International Search Report of PCT Application No. US12/31801, date of mailing of ISR Jul. 20, 2012, 2 pages.

European Patent Office, extended European Search Report issued on European patent application No. 12768685.5, completed Dec. 4, 2014 (received Dec. 9, 2014), 6 pages.

State Intellectual Property Office of the People's Republic of China, First Office Action and Search Report issued on CN Application No. 201280017173.3, issued on May 7, 2015, received May 15, 2015, 6 pages.

* cited by examiner

DEVICE FOR HOLDING A SOURCE OF LED LIGHT

RELATED APPLICATION INFORMATION

This application claims the benefit of U.S. Provisional Application No. 61/473,475, filed on Apr. 8, 2011, the disclosure of which is incorporated herein by reference in its entirety.

BACKGROUND

Devices for holding a source of LED light, e.g., a LED light engine or a LED light module, are known in the art. By way of example only, LED lamp holding devices are shown in Published US Application No. 20110028015; Published US Application No. 20100290236; Published US Application No. 20090203254; Published US Application No. 20090196034; and U.S. D627,296. While such LED lamp holding devices generally work for their intended purpose, a need exists for an improved LED lamp holder, e.g., a LED lamp holder that provides compact design, ease of LED light installation and removal, economical cost of construction, etc.

SUMMARY

Described hereinafter are improved lamp holders, particularly for holding a source of LED light, which provide the advantages above-noted as well as others that will be appreciated by those of ordinary skill in the art.

More particularly, and by way of non-limiting example, the lamp holders include a lamp holding component that is sized and arranged to securely receive the source of LED light. Keyed openings, engageable with fasteners associated with a mounting surface, such as a the heat sink, are used to releasably attached the lamp holding component to the mounting surface and to urge the source of LED light against the mounting surface once the lamp holding component is attached thereto. Electrical contacts carried by the lamp holding component, provided to engage corresponding electrical contacts of the source of LED light, are also arranged to urge the source of LED light against the mounting surface when the lamp holding component is attached to the mounting surface. The lamp holding component also includes one or more holding elements for releasably holding the source of LED light in an accessible location and for still further urging the source of LED light against the mounting surface when the lamp holding component is attached to the mounting surface.

While the foregoing provides a general description of the subject lamp holders and some advantages thereof, a better understanding of the objects, advantages, features, properties, and relationships of the subject lamp holders will be obtained from the following detailed description and accompanying drawings which set forth illustrative embodiments and which are indicative of the various ways in which the principles of the invention may be employed.

BRIEF DESCRIPTION OF THE DRAWINGS

For a better understanding of the hereinafter described lamp holders for holding a source of LED light, reference may be had to the following drawings in which.

DETAILED DESCRIPTION

Figure 1:
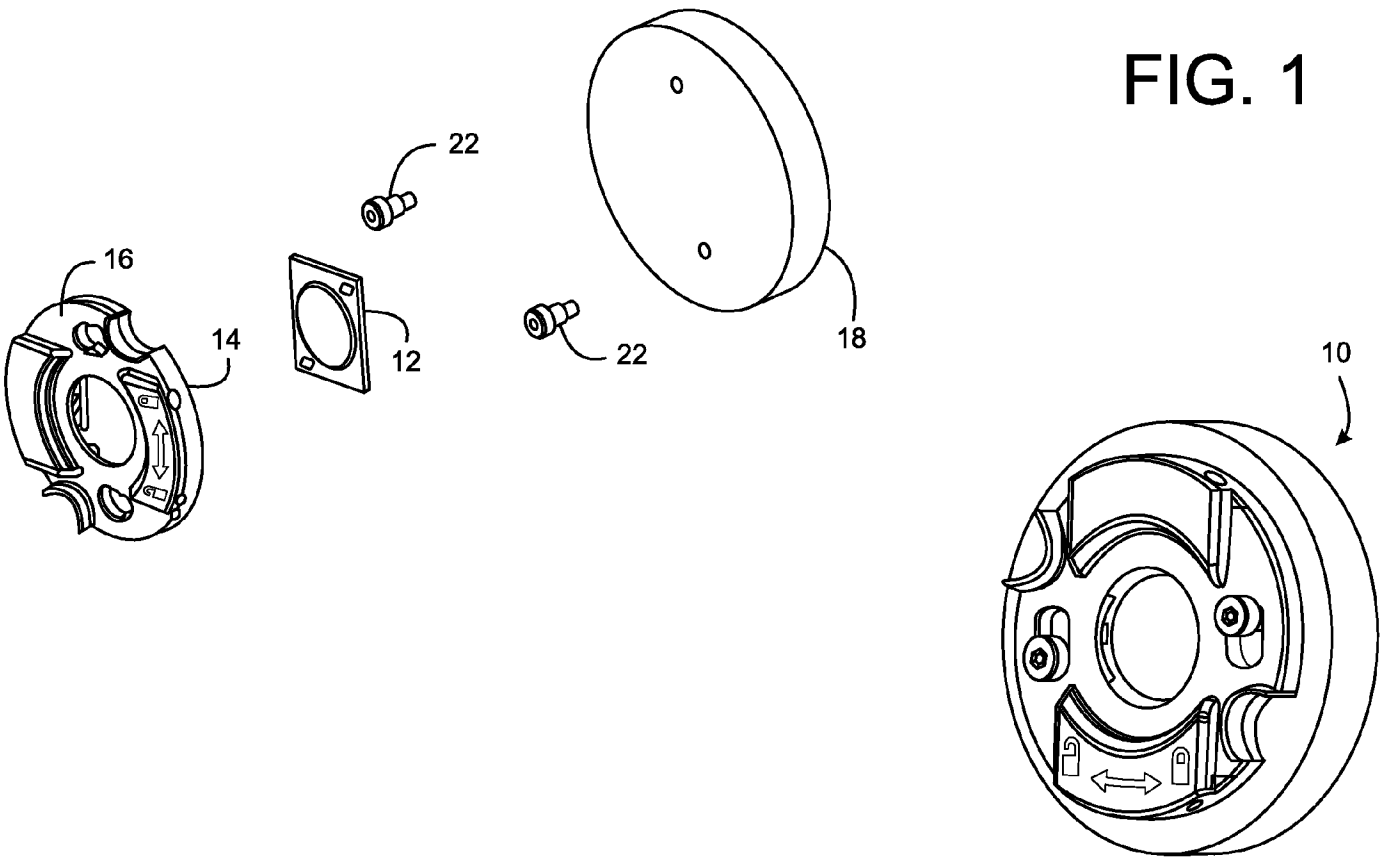
FIGS. 1 and 2 illustrate an exploded view of an exemplary lamp holder for holding a source of LED light constructed according to the description that follows.
Figure 2:
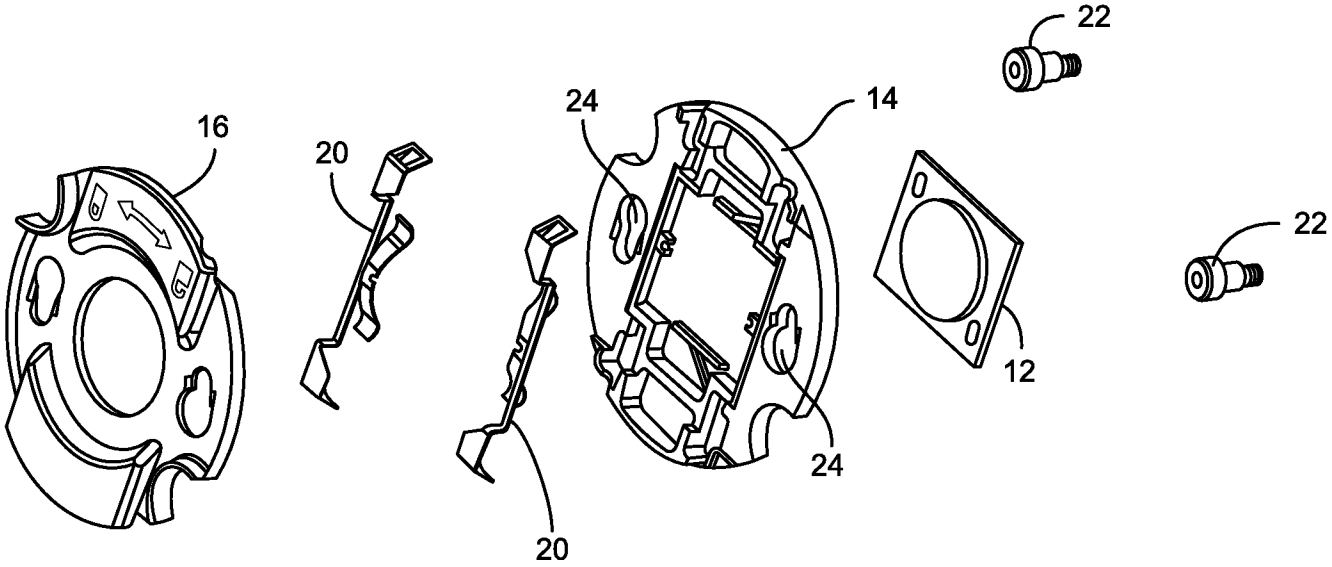

Turning now to the Figures, illustrated are various embodiments of components that are usable to construct a lamp holder for holding a source of LED light. By way of example only, FIGS. 1 and 2 illustrate a lamp holder 10 for holding a source of LED light 12 comprised of a lamp holding component 14 with optional cover component 16, a mounting surface 18, which may be a heat sink, electrical contacts 20 (for engaging corresponding contacts of the source of LED light 12 when the source of LED light 12 is inserted into the lamp holding component 14), and fasteners 22 (for removeably securing the lamp holding component 14—and the optional cover component 16—to the mounting surface 18). While not limiting, the lamp holder 10 may be placed within a can enclosure or luminaire such as commonly used in overhead lighting fixtures. Furthermore, the optional cover component 16 and/or the lamp holding component 14 can be adapted to be coupled with or otherwise be provided with additional optical components as desired, e.g., a lens to provide desired light dispersion characteristics, etc., and can be sized and arranged as necessary to accommodate sources of LED light of varying shapes and sizes. Preferably, at least the lamp holding component 14 and the cover component 16 are formed from a plastic material. It will be understood that other materials may also be utilized as needed for any particular purpose, e.g., metal materials that are resistant to plastic creep issues could also be utilized for one or more of the components. Yet further, the fasteners 22 can be releasably matable with the mounting surface 18 (for example by providing the fasteners 22 with threads or the like) or be formed as an integral part of the mounting surface 18.

For releasably securing the lamp holding component 14 and the optional cover component 16 to the mounting surface 18 (and thereby the LED lamp assembly 12 between the lamp holding component 14 and the mounting surface 18), the lamp holding component 14 and the cover component 16 are provided with one or more keyed openings 24. As particularly illustrated in FIG. 3, the keyed openings 24 include a first portion 24A, which is sized to accept the head portion 22A of a corresponding fastener 22, and a second portion 24B, which is sized smaller than the head portion 22A of the corresponding fastener 22. The lamp holding component 14 and/or the optional cover component 16 is thus secured to the mounting surface 18 by positioning the fasteners 22 within the first portion 24A of the keyed opening 24 and by then twisting, sliding, or otherwise moving the lamp holding component 14 and/or optional cover component 16 relative to the fasteners 22 such that the head portion 22A of the fasteners 22 is moved into the smaller sized second portion 24B of the keyed openings 24, i.e., the lamp holding component 14 and/or the optional cover component 16 is moved such that the upper surface of the lamp holding component 14 and/or the optional cover component 16 becomes engaged with the underside of the head portion 22A of the fasteners 22. As will be appreciated, such an arrangement allows the holding component 14 and/or the optional cover component 16 to be removed from the mounting surface 18 without also requiring the removal of the fasteners 22 from the mounting surface 18 (in the event that the fasteners 22 are also releasably secured to the mounting surface 18).

Figure 3:
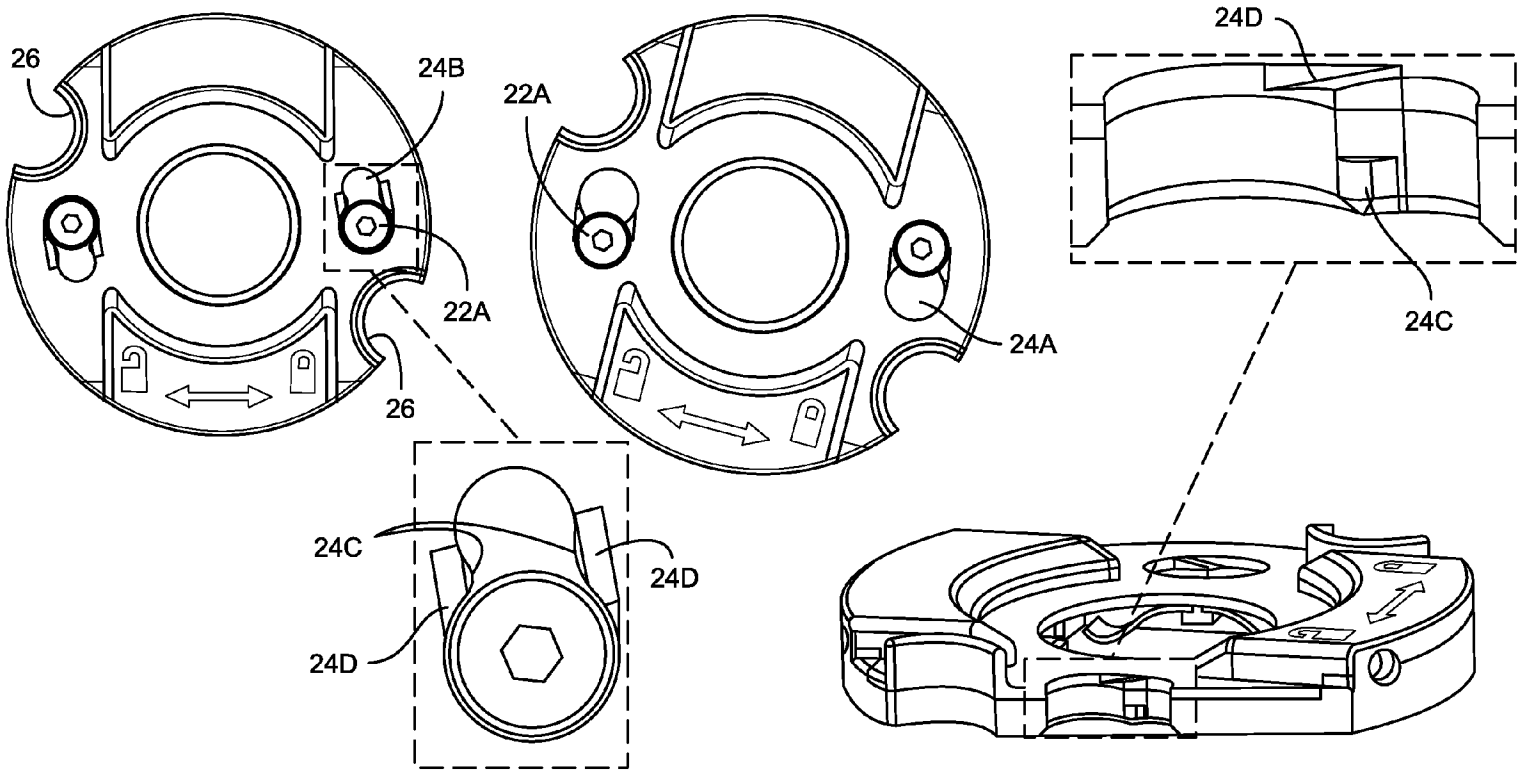
FIGS. 3 and 4 illustrate a top and perspective view of the exemplary lamp holder for holding a source of LED light.

To releasably lock at least the lamp holding component 14 to the mounting surface 18, the keyed openings 24 of at least the lamp holding component may be provided with tabs 24C that function to inhibit the fasteners 22 from exiting the second portion 24B of the keyed opening 24. As illustrated in FIG. 3, the tabs 24C may be in the form of bumps or the like that protrude inwards into the keyed opening 24 intermediate the first portion 24A and the second portion 24B. As will be appreciated, the illustrated bumps would be capable of being moved outwardly relative to the keyed opening 24 when the fastener 22 is forced thereover owing to the resilient or deformable nature of the plastic used in constructing the lamp holding component 14. In other embodiments, the tabs 24C could take the form of springs or the like without limitation. As will also be appreciated, similar structure could be provided to the cover portion 16 to serve this same purpose.

To assist in urging a LED lamp assembly 12 disposed in the holding component 14 against the mounting surface 18 when the holding component 14 is secured and locked to the mounting surface 18, the keyed opening 24 may then be provided with inclined surfaces 24D. As seen in FIG. 3, the inclined surfaces 24D slope generally upward from the first portion 24A to the second portion 24B of the keyed opening 24 such that, when the holding component 14 is moved relative to the fasteners 22 towards the locked position, the underside of the head portion 22A of the fasteners engages with the inclined surfaces 24D and increasingly more force is provided upon the lamp holding component 14 as it is further moved to thereby increasingly force or drive the lamp holding component 14, and the lamp LED lamp assembly 12 carried thereby, towards the mounting surface 18.

Figure 4:
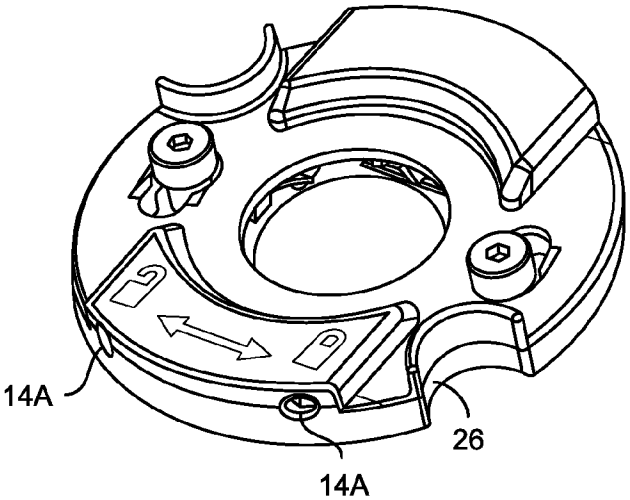
Figure 4:
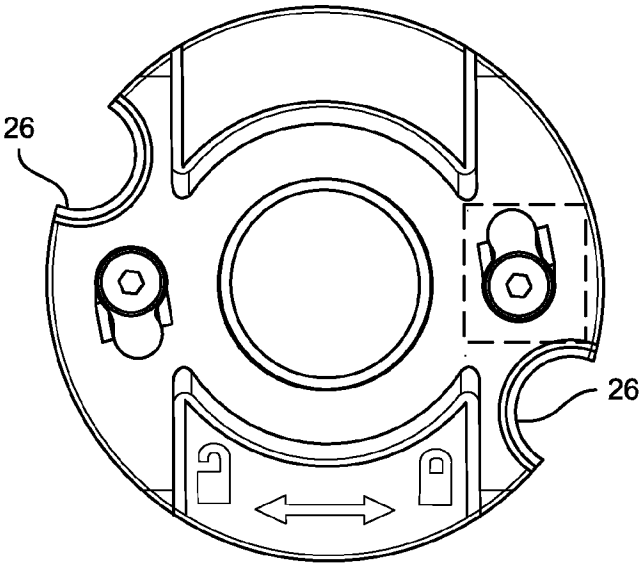

To assist a user in moving the lamp holding component 14 and/or the optional cover portion 16 relative to the fasteners 22, the lamp holding component 14 and/or optional cover portion 16 may be provided with one or more finger grasping portions 26 as illustrated in FIG. 4. The one or more finger grasping portions 26 may be in the form of arcuately shaped indentations and may be provided to opposed sides of the holding component 14 and/or optional cover portion 16 as particularly illustrated. As will be understood, the use of indentations as finger grasping portions 26 may be desirable as such indentions function to limit the need for any additional structures that might interfere with the optical elements of the assembly. Nevertheless, in certain circumstances and as need for a given purpose, such finger grasping portions 26 could be in the form of low-profile protuberances or the like that extend outward from the sides of the holding component 14 and/or optional cover portion 16, may be in the form of low-profile protuberances or the like the extend upwardly from a top surface of the holding component 14 and/or optional cover portion 16, and the like without limitation. In any case, what is desired is to provide a non-smooth or non-slip feature to a surface to the holding component 14 and/or the optional cover portion 16 that can be conveniently grasped by a user to thereby move the holding component 14 and/or the optional cover portion 16 relative to the fasteners 22.

Figure 5:
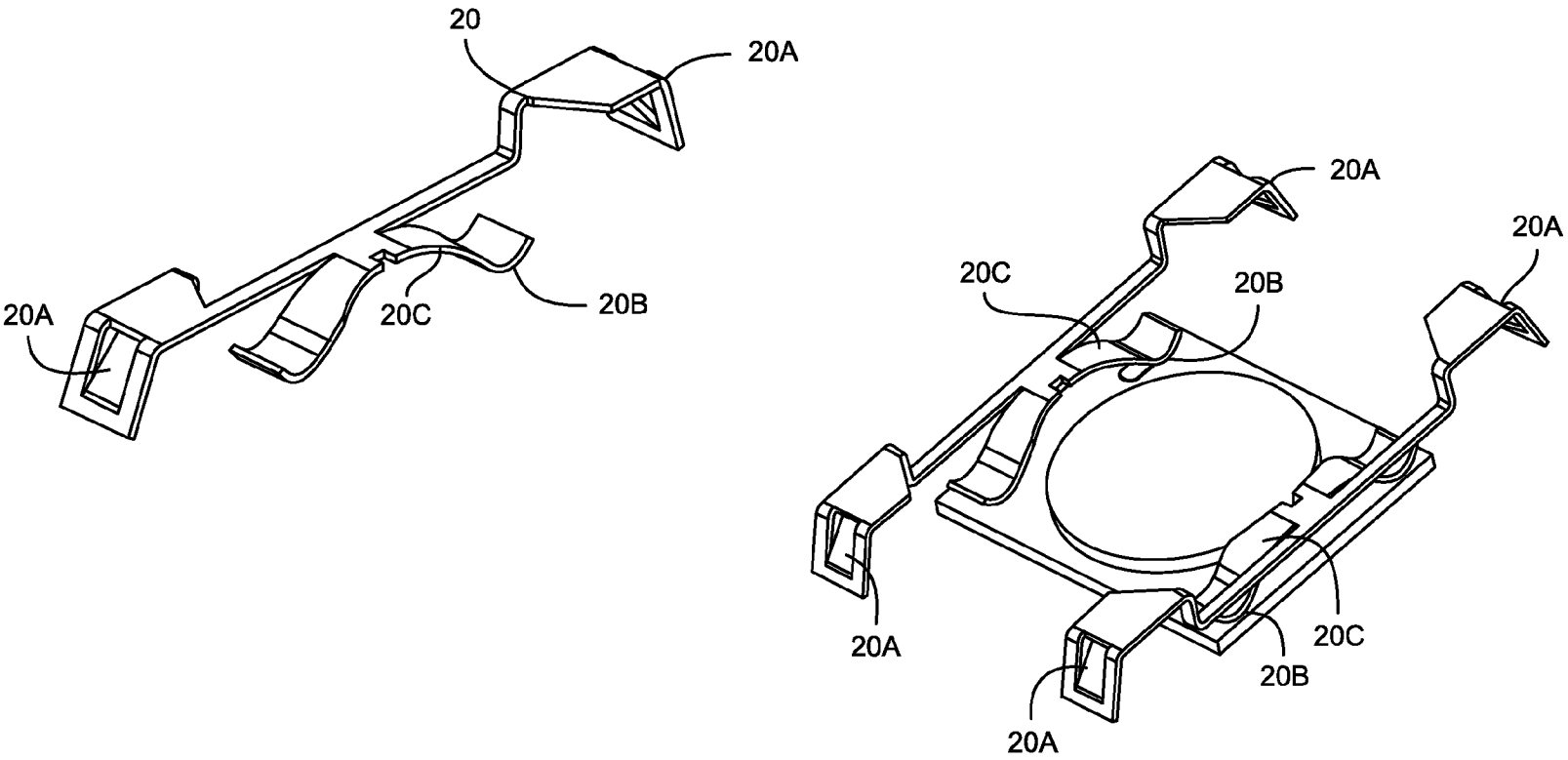
FIG. 5 illustrates exemplary electrical contact portions of the lamp holder for holding a source of LED light.
Figure 6:
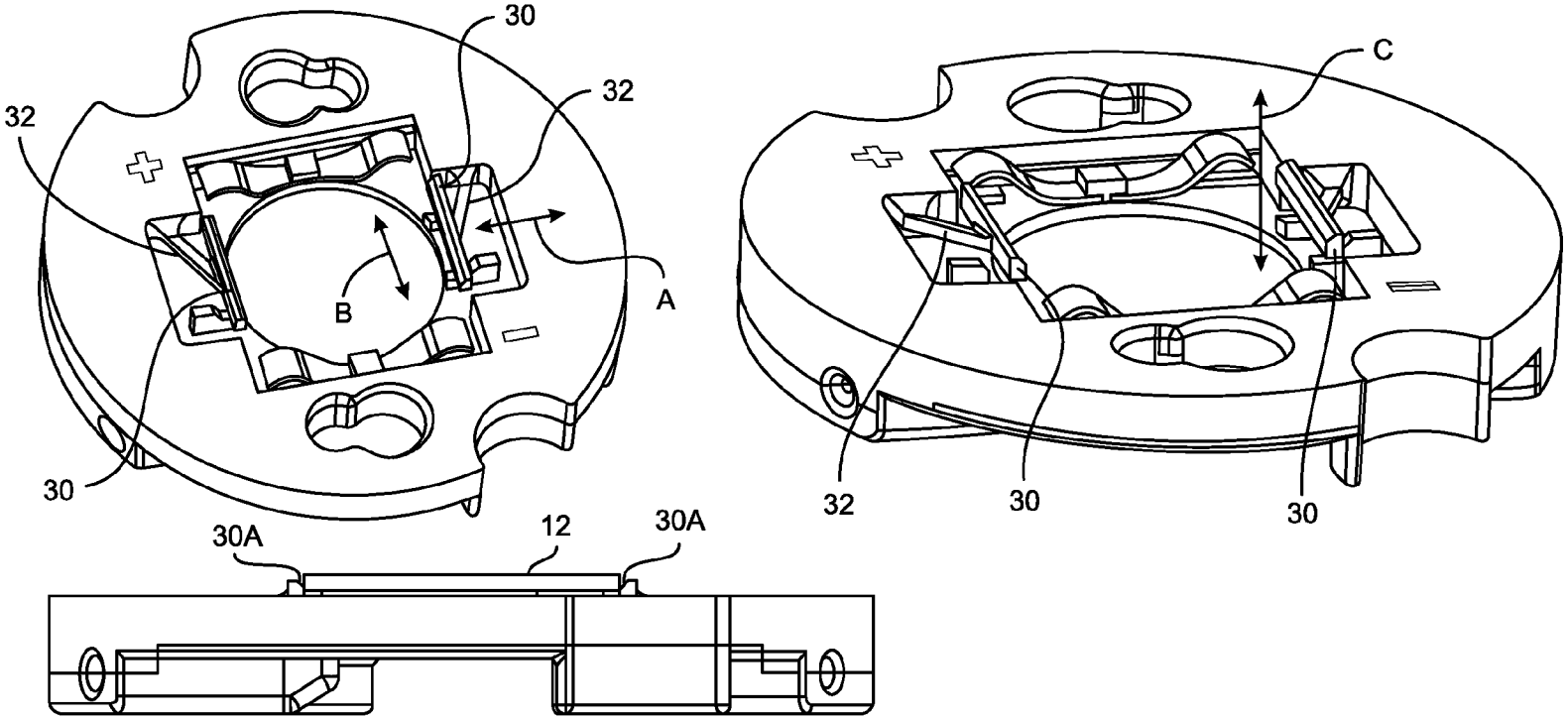
FIG. 6 illustrates exemplary LED light source holding elements of the lamp holder for holding a source of LED light.
Figure 7:
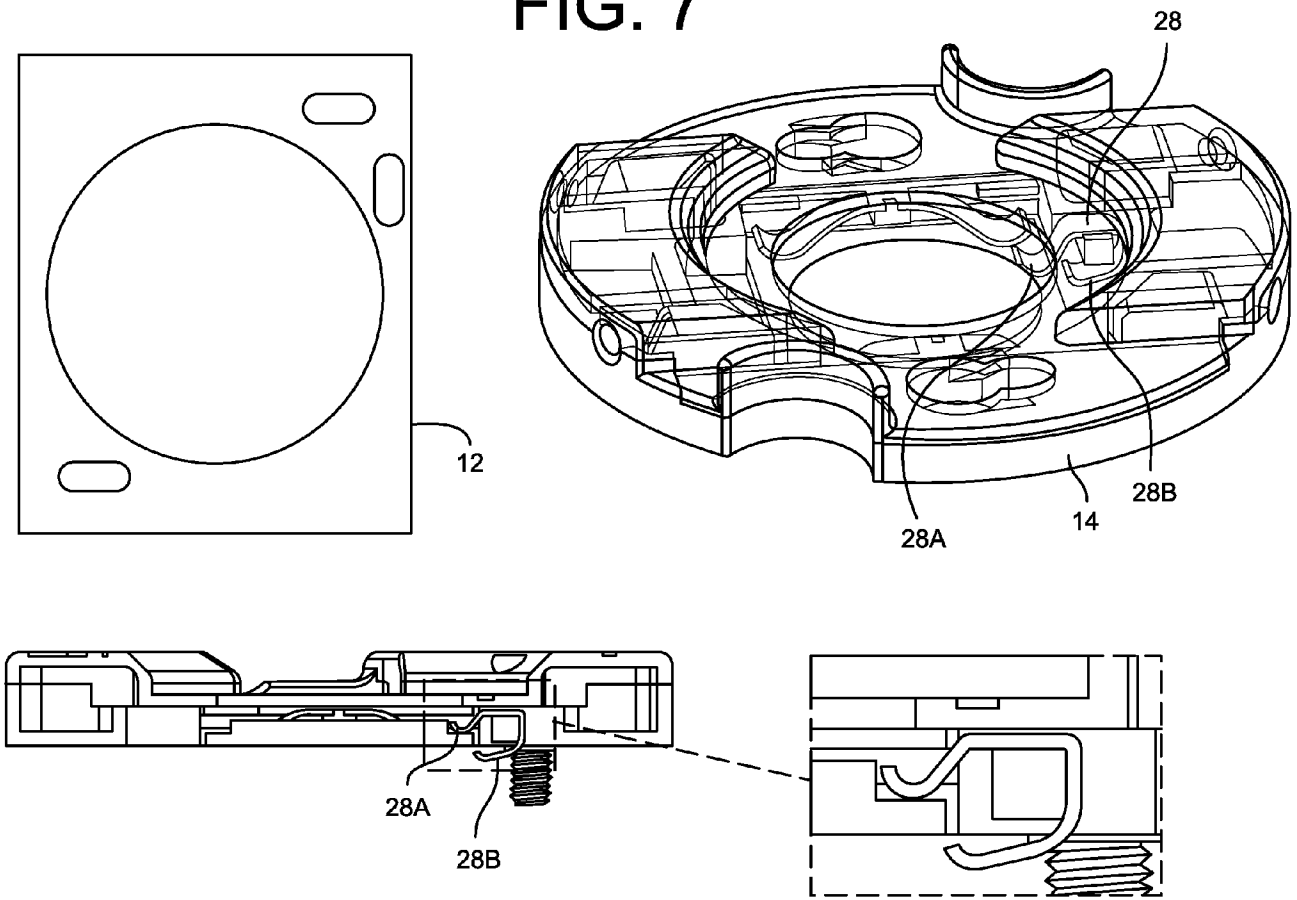
FIG. 7 illustrates an exemplary lamp holder for holding a source of LED light with the optional cover portion being shown with transparency.

For allowing electrical connections to be made with a LED light source 12 disposed within the lamp holding component 14, electrical terminals 20 are provided. As particularly shown in FIGS. 2, 5, and 6, the electrical terminals 20 are securely mounted to the lamp holding component 14 and include one or more electrical connection points 20A as well as one or more contacts 20B that are arranged to engage with corresponding electrical contacts formed on the source of LED light (as shown in FIG. 7). The electrical connection points 20A may incorporate any known structure to thereby allow an electrical lead to be engaged therewith. By way of non-limiting example, an electrical lead may be soldered to, pushed-into, crimped on, etc. to the electrical connection points 20A. Leads connected to the electrical lead junction points 20A will preferably exit from side openings 14A provided to the lamp holding component 14.

For urging the source of LED light 12 against the mounting surface 18, the contacts 20B are preferably mounted to the electrical terminals 20 via use of a resilient arm 20C. In the example illustrated in the figures, the contacts 20B are formed on a leaf spring that is an integrally formed portion of the electrical terminals 20 and which provides an axial downward force upon the source of LED light 12. As further illustrated, each leaf spring is arranged to provide a distributed force upon the source of LED light 12 with at least one side of the leaf spring actually providing an electrical connection with a corresponding electrical contact of the source of LED light 12. It will be appreciated that further resilient devices can be used in place of the illustrated leaf spring to provide a similar downward force upon the source of LED light 12 and, as such, the illustrated arrangement is not meant to be limiting.

To provide an electrical connection, e.g., a grounding electrical connection, between the source of LED light 12 and the mounting surface 18 or other conductive part within a luminaire which includes the lamp holder 10, a single piece, contact 28 may be provided as illustrated in FIG. 7. While not intended to be limiting, the single piece contact 28 provides a first portion 28A arranged to contact a corresponding contact of the source of LED light 12 and a second portion 28B which is arranged to contact the mounting surface 18 when the holding component 14 is secured thereto. The contact 28 is preferably constructed of a resilient material such that the first portion 28A and the second portion 28B are urged into contact with the source of LED light 12 and mounting surface 18, respectively.

For positioning a source of LED light 12 within the lamp holding component 14, particularly to hold the source of LED light 12 within the lamp holding component 14 before the lamp holding component 14 is mounted to the mounting surface 18 and to further urge the source of LED light 12 towards the mounting surface 18 when the lamp holding component 14 is secured to the mounting surface 18, the lamp holding component 14 is provided with one or more, e.g., a pair of oppositely positioned, holding elements 30. As particularly illustrated in FIG. 6 by way of example only, a pair of holding elements 30 may be arranged so as to engage opposed sides of the source of LED light 12 when the source of LED light 12 is inserted therebetween. While not required, the one or more holding elements 30 are illustrated as being carried by one or more resilient arms 32 which allow the one or more holding elements 30 to move in multiple directions A, B, and C as illustrated in FIG. 6. The one or more holding elements 30 may also be generally pivotable about their point of connection with the one or more resilient arms 32. In this manner, the one or more holding elements 30 may deflect as necessary to engage the sides of the source of LED light 12 when the source of LED light 12 is positioned within the lamp holding component 14 and, thereafter, to apply a force upon the sides of the source of LED light 12 to thereby hold the source of LED light 12 within the lamp holding component 14. The insertion of the source of LED light 12 into the lamp holding component 14, particularly between the one or more holding elements 30, may be further facilitated by providing the one or more holding elements 30 with chamfered edges 30A. While the one or more holding elements 30 and the one or more resilient arms 32 are shown as being integrally formed with the lamp holding component 14, it will be appreciated that multiple components could also be utilized, e.g., the one or more holding elements 30 could be mounted to further provided springs or the like. As further illustrated in FIG. 6, the one or more holding elements 30 are preferably arranged to extend out of the lamp holding component 14 to thereby expose at least a portion of the source of LED light 12 which thereby allows the source of LED light 12 to be easily grasped for insertion into or removal from the lamp holding component 14. In addition, when the lamp holding component 14 is secured to the mounting surface 18, the resilient nature of and arrangement of the one or more holding elements 30 allows the source of LED light 12 to be positioned against the electrical contacts 20 while also allowing the one or more holding elements 30 to urge the source of LED light 12 against the mounting surface 18.

Figure 8:
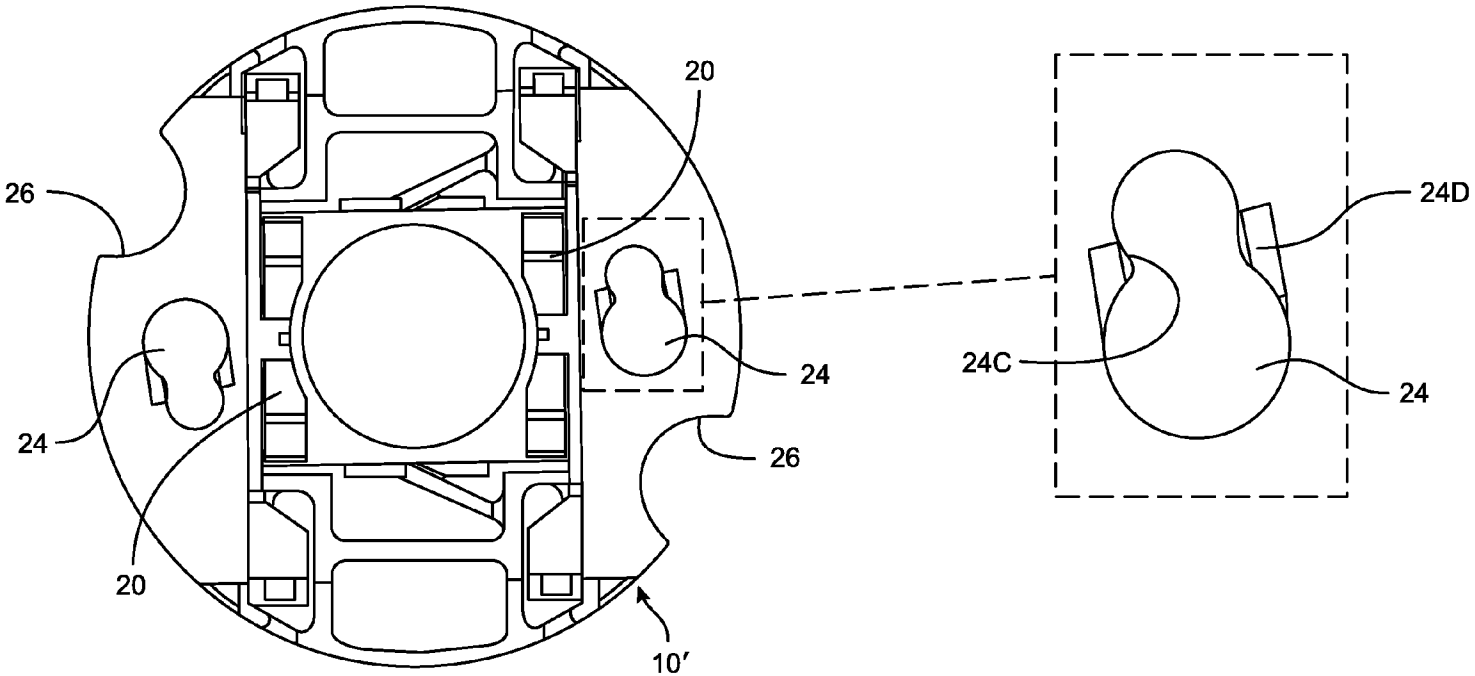
FIG. 8 illustrates a further exemplary lamp holder for holding a source of LED light.

While specific embodiments of the subject invention have been described in detail, it will be appreciated by those skilled in the art that various modifications and alternatives to those details could be developed in light of the overall teachings of this disclosure. For example, FIG. 8 illustrates a single piece lamp holder 10' which does not utilize a cover but having many of the components described above, e.g., keyed openings 24, electrical contacts 20 snapped, press-fit, or the like to the holding component, resilient holding elements 30, etc. It will therefore be appreciated that features described with respect to the various embodiments are not to be limited to any particular embodiment but may be freely used across embodiments where applicable. Additionally, it will be appreciate that the size, shape, arrangement, and/or number of components illustrated and described can be changed as necessary to meet a given need. Accordingly, the particular arrangements disclosed are meant to be illustrative only and not limiting as to the scope of the invention which is to be given the full breadth of the appended claims and any equivalents thereof.

What is claimed is:

1. A lamp holder for holding a printed circuit board (PCB) having a source of LED light on a mounting surface, comprising:

a lamp holding component that is sized and arranged to receive and securely hold therewithin the PCB having the source of LED light when the lamp holding component is secured to the mounting surface, the lamp holding component having at least one electrical terminal having at least one electrical contact adapted to engage a corresponding electrical contact of the PCB having the source of LED light wherein the electrical terminal is disposed substantially below a surface of the lamp holding component and wherein the at least one electrical contact of the electrical terminal is resiliently coupled to the lamp holding component to solely provide all forces in a direction that is away from the surface of the lamp holding component for urging the PCB having the source of LED light against the mounting surface when the lamp holding component is attached to the mounting surface.

2. The lamp holder as recited in claim 1, wherein the at least one electrical contact is formed on a leaf spring attached to the electrical terminal.

3. The lamp holder as recited in claim 2, wherein the leaf spring provides opposed ends adapted to urge the PCB having the source of LED light against the mounting surface when the lamp holding component is attached to the mounting surface and wherein at least one of the opposed ends provides the at least one electrical contact.

4. The lamp holder as recited in claim 2, wherein the leaf spring is integrally formed with the electrical terminal.

5. The lamp holder as recited in claim 1, wherein the electrical terminal is adapted to be engaged with at least one electrical lead.

6. A lamp holder for holding a printed circuit board (PCB) having a source of LED light on a mounting surface, wherein the PCB has a top surface which carries the source of LED light, a bottom surface which is to be disposed towards the mounting surface, and one or more side surfaces intermediate the top surface and the bottom surface, comprising:

a lamp holding component that is sized and arranged to receive and securely hold therewithin the PCB having the source of LED light when the lamp holding component is secured to the mounting surface, the lamp holding component having at least one holding element adapted to engage a side surface of the PCB having the source of LED light when the PCB having the source of LED light is inserted into the lamp holding component.

7. The lamp holder as recited in claim 6, wherein the lamp holding component has a pair of holding elements adapted to engage opposed side surfaces of the PCB having the source of LED light.

8. The lamp holder as recited in claim 6, wherein the at least one holding element is moveable in multiple directions relative to the lamp holding component.

9. The lamp holder as recited in claim 6, wherein the at least one holding element is mounted to a resilient arm extending from the lamp holding component.

10. The lamp holder as recited in claim 9, wherein the holding element, the resilient arm, and the lamp holding element are integrally formed.

11. The lamp holder as recited in claim 9, wherein the pair of holding elements are arranged to hold the PCB having the source of LED light so the bottom surface of the PCB having the source of LED light will be positioned outside of an interior of the lamp holding component.

12. The lamp holder as recited in claim 11, wherein the pair of holding elements are arranged to urge the bottom surface of the PCB having the source of LED light against the mounting surface when the lamp holding component is attached to the mounting surface.

13. The lamp holder as recited in claim 11, wherein the pair of holding elements have chamfered edges for easing insertion of the PCB having the source of LED light into a position of engagement between and with the pair of holding elements.

14. A lamp holder for holding a printed circuit board (PCB) having a source of LED light on a mounting surface, comprising:

a lamp holding component sized and arranged to receive and securely hold therewithin the source of LED light when the lamp holding component is secured to the mounting surface, the lamp holding component having a resilient contact having a first portion adapted to engage a corresponding contact of the PCB having the source of LED light and a second portion adapted to engage with the mounting surface when the lamp holding component is secured to the mounting surface.

15. The lamp holder as recited in claim 14, wherein the resilient contact comprises a grounding contact.

* * * * *